US006965825B2

(12) United States Patent
Hosoya et al.

(10) Patent No.: US 6,965,825 B2
(45) Date of Patent: Nov. 15, 2005

(54) CONTROL APPARATUS FOR VEHICLE AND METHOD THEREOF

(75) Inventors: Hajime Hosoya, Atsugi (JP); Satoru Watanabe, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/886,045

(22) Filed: Jul. 8, 2004

(65) Prior Publication Data

US 2005/0028792 A1 Feb. 10, 2005

(30) Foreign Application Priority Data

Jul. 11, 2003 (JP) ..... 2003-195448

(51) Int. Cl.[7] ..... F02M 37/04
(52) U.S. Cl. ..... 701/114; 123/520; 73/118.1
(58) Field of Search ..... 123/516–520, 123/198 D; 701/114; 73/118.1

(56) References Cited

U.S. PATENT DOCUMENTS

| | | | | |
|---|---|---|---|---|
| 5,190,009 | A * | 3/1993 | Kadota | 123/339.14 |
| 5,263,462 | A | 11/1993 | Reddy | |
| 5,462,034 | A * | 10/1995 | Kadota | 123/520 |
| 6,640,620 | B2 * | 11/2003 | Cook et al. | 73/118.1 |
| 6,807,851 | B2 * | 10/2004 | Wakahara et al. | 73/118.1 |
| 6,877,490 | B2 * | 4/2005 | Nishioka et al. | 123/520 |
| 2001/0002453 | A1 * | 5/2001 | Kondo | 701/114 |
| 2002/0002429 | A1 * | 1/2002 | Sugimura et al. | 701/29 |

* cited by examiner

*Primary Examiner*—Thomas Moulis
(74) *Attorney, Agent, or Firm*—Foley & Lardner LLP

(57) ABSTRACT

In a diagnosis control for periodically detecting a pressure in a fuel tank during an operation of an engine is stopped, to diagnose whether or not the leakage occurs in a fuel vapor purge system, the power supply to a sensor detecting the pressure in the fuel tank is intermittently performed at each detection period.

20 Claims, 4 Drawing Sheets

CONTROL APPARATUS FOR VEHICLE AND METHOD THEREOF

FIELD OF THE INVENTION

The present invention relates to a control apparatus for a vehicle for detecting a state of the vehicle after an engine operation is stopped, and a method thereof.

RELATED ART

U.S. Pat. No. 5,263,462 discloses an apparatus for detecting a vehicle state after an engine operation is stopped.

The above apparatus is a diagnosis apparatus for diagnosing whether or not the leakage occurs in a fuel vapor purge system.

In this diagnosis apparatus, the temperature and a pressure in a fuel tank are detected after the engine operation is stopped, and a change in the temperature and a change in the pressure are compared with each other, to diagnose whether or not the leakage occurs.

However, since a generator does not operate during the engine operation is stopped, if a period of time during which the diagnosis apparatus is operated for the leakage diagnosis is lengthened, a battery, that is, a power source of the diagnosis apparatus, is drained.

SUMMARY OF THE INVENTION

The present invention has an object to reduce the power consumption of a control apparatus for detecting a vehicle state after an engine operation is stopped.

In order to achieve the above object, the present invention is constituted so that the power supply to a detector outputting a signal corresponding to a vehicle state is controlled, according to a detection request of the vehicle state, during an engine operation is stopped.

The other objects and features of this invention will become understood from the following description with reference to the accompanying drawings.

DESCRIPTION OF EMBODIMENTS

Figure 1:
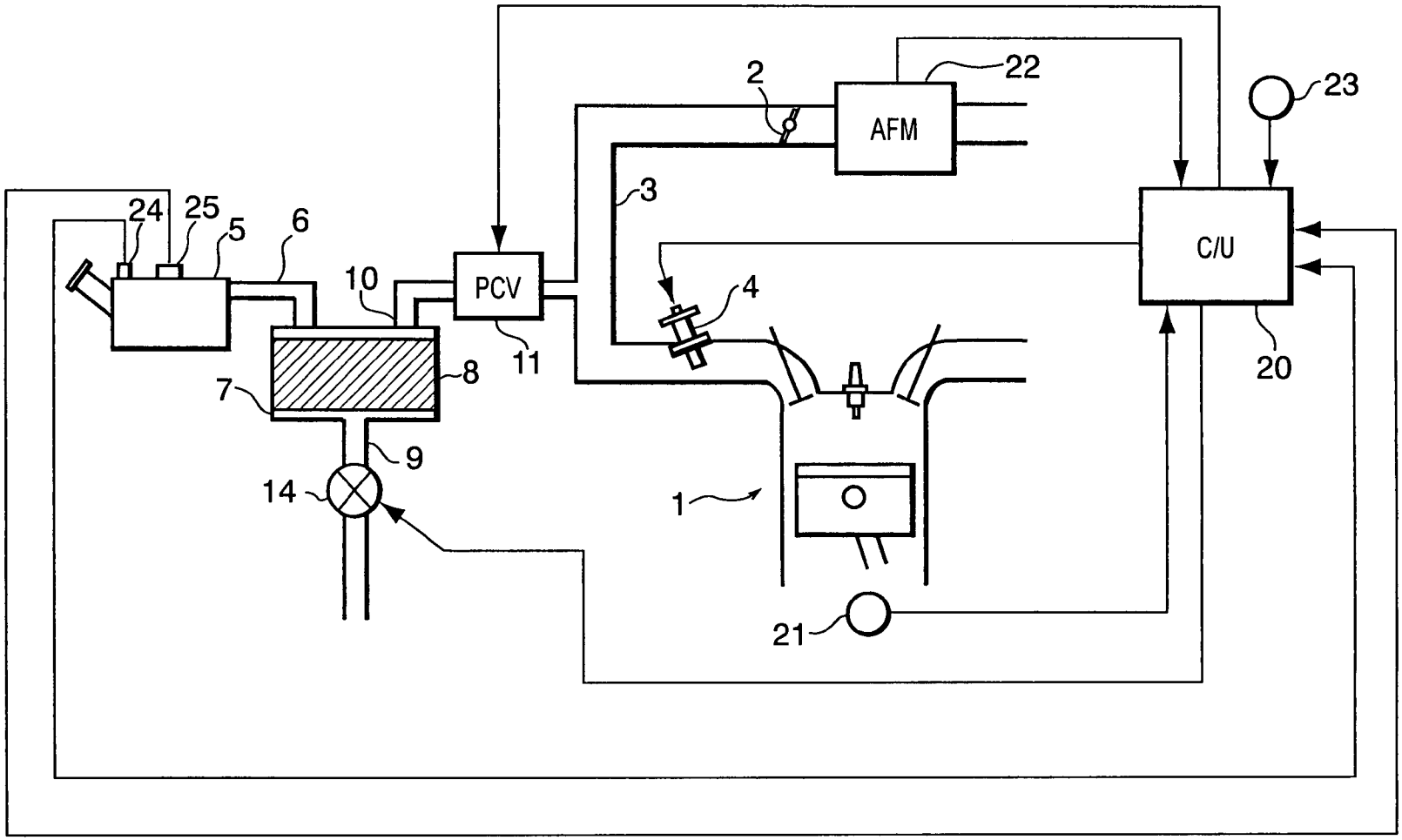
FIG. 1 is a diagram showing a system configuration of an internal combustion engine in an embodiment.

In FIG. 1, an engine 1 is an internal combustion engine installed in a vehicle (not shown in the figure) and using gasoline as fuel.

A throttle valve 2 is disposed in an intake system of engine 1.

An intake air amount of engine 1 is controlled according to an opening of throttle valve 2.

For each cylinder, an electromagnetic type fuel injection valve 4 is disposed in a manifold portion of an intake passage 3 on the downstream side of throttle valve 2.

Fuel injection valve 4 is opened based on an injection pulse signal output from a control unit 20, to inject fuel.

Engine 1 is provided with a fuel vapor purge system.

Fuel vapor purge system comprises an evaporation passage 6, a canister 7, a purge passage 10 and a purge control valve 11.

Fuel vapor generated in a fuel tank 5 is introduced to canister 7 via evaporation passage 6.

Canister 7 is a container filled with the adsorbent 8 such as activated carbon.

Further, a new air inlet 9 is formed to canister 7, and purge passage 10 is extended out from canister 7.

Purge passage 10 is connected to intake passage 3 on the downstream side of throttle valve 2.

Closed type purge control valve 11 is disposed in the halfway of purge passage 10.

An opening of purge control valve 11 is controlled based on a purge control signal output from control unit 20.

The fuel vapor generated in fuel tank 5 is introduced to canister 7 via evaporation passage 6, to adsorptively trapped in canister 7.

When a predetermined purge permission condition is established during an operation of engine 1, purge control valve 11 is controlled to open.

Then, as a result that an intake negative pressure of engine 1 acts on canister 7, the fuel vapor adsorbed in canister 7 is purged by the fresh air introduced through new air inlet 9.

Purged gas inclusive of the purged fuel vapor passes through purge passage 10 to be sucked in intake passage 3.

Further, an electromagnetic valve 14 is disposed on new air inlet 9 of canister 7, for blocking new air inlet 9 when the leakage diagnosis is performed.

Electromagnetic valve 14 is a closed type electromagnetic valve, which is fully closed when the power supply is shut off.

Control unit 20 incorporates therein a microcomputer comprising a CPU, a ROM, a RAM, an A/D converter and an input/output interface.

Control unit receives detection signals from various sensors.

As the various sensors, there are provided a crank angle sensor 21 outputting a crank angle signal in synchronism with a rotation of engine 1, an air flow meter 22 measuring an intake air amount of engine 1, a vehicle speed sensor 23 detecting a vehicle speed, a pressure sensor 24 detecting a pressure in fuel tank 5, and a temperature sensor detecting the temperature in fuel tank 5.

Note, there is provided a generator driven by engine 1, and control unit 20 operates using a battery charged by the generator, as a power source thereof.

Here, control unit 20 controls fuel injection valve 4 and purge control valve 11, based on engine operating conditions detected by the various sensors.

Further, control unit 20 includes a function of diagnosing an occurrence of leakage in the fuel vapor purge system.

The leakage diagnosis is performed by detecting a change in pressure in fuel tank 5 after the operation of engine 1 is stopped.

When the operation of engine 1 is stopped, and the power supply to purge control valve 11 and electromagnetic valve 14 is stopped, purge control valve 11 and electromagnetic valve 14 are closed.

In closed states of purge control valve 11 and electromagnetic valve 14, a diagnosis block including fuel tank 2, evaporation passage 6, canister 7 and purge passage 10 is blocked.

Here, due to the condensation of the time when the temperature of gasoline vapor is lowered, a pressure in the diagnosis block is reduced.

Therefore, if the pressure in the diagnosis block reaches a negative pressure due to the pressure reduction, it is judged that there is no leakage. When the pressure in the diagnosis block does not reach the negative pressure, it is judged that the leakage occurs.

In the above leakage diagnosis, it is necessary that control unit 20 reads an output from pressure sensor 24 to detect the pressure in the diagnosis zone, after the operation of engine 1 is stopped.

However, the generator does not operate during the operation of engine 1 is stopped, and accordingly, the battery being the power source of control unit 20 is not charged.

Therefore, if the power consumption of control unit 20 during the engine operation is stopped, is large, the battery is drained.

Since the battery is also used as the power source of a starter for starting the operation of engine 1, the battery drain results in the deterioration of startability of engine 1.

Figure 2:
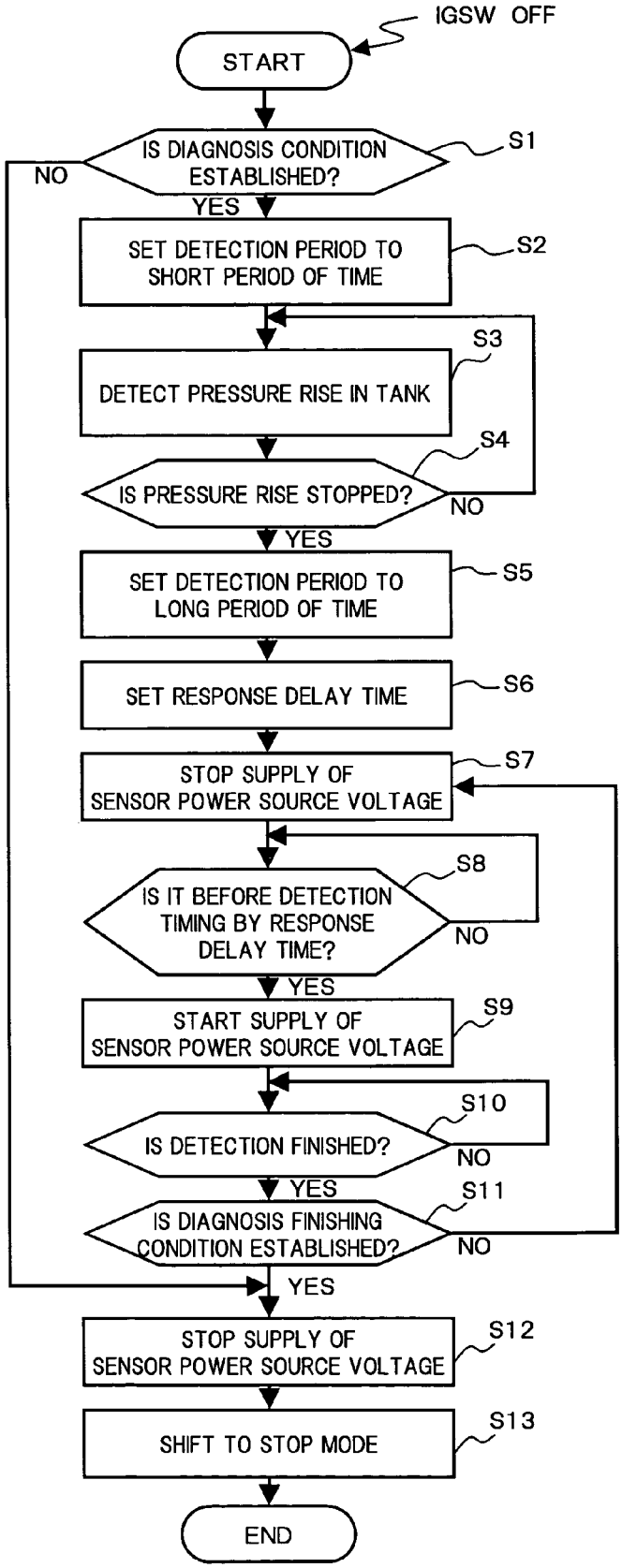
FIG. 2 is a flowchart showing the leakage diagnosis in the embodiment.

The power consumption of control unit 20 during the engine operation is stopped, is reduced in accordance with the process shown in a flowchart of FIG. 2.

A routine shown in the flowchart of FIG. 2 is executed when an ignition key is turned OFF.

In step S1, it is judged whether or not a leakage diagnosis condition is established.

As the leakage diagnosis condition, it is judged that pressure sensor 24 is not failed, and that a battery voltage is a predetermined voltage or above.

If the diagnosis condition is not established, since the leakage diagnosis based on the output from pressure sensor 24 is not executed, control proceeds to step S12.

In step S12, the power supply to pressure sensor 24 is stopped.

In next step S13, control unit 20 shifts itself to a stop mode or a low power consumption mode.

Note, the stop mode is the one in which control unit 20 shuts off the battery power supply for itself. Further, the low power consumption mode is the one in which control unit 20 becomes in a standby condition where the power consumption is less than that at a normal operation time.

On the other hand, if it is judged in step S1 that the diagnosis condition is established, control proceeds to step S2.

In step S2, a previously set short period is set as a detection period of the pressure in fuel tank 5.

In step S3, an output signal from pressure sensor 24 is read at each short period.

Thus, the pressure rise in fuel tank 5 due to a vapor pressure of fuel is detected.

In step S4, it is judged whether or not the pressure rise in fuel tank 5 is stopped.

Figure 3:
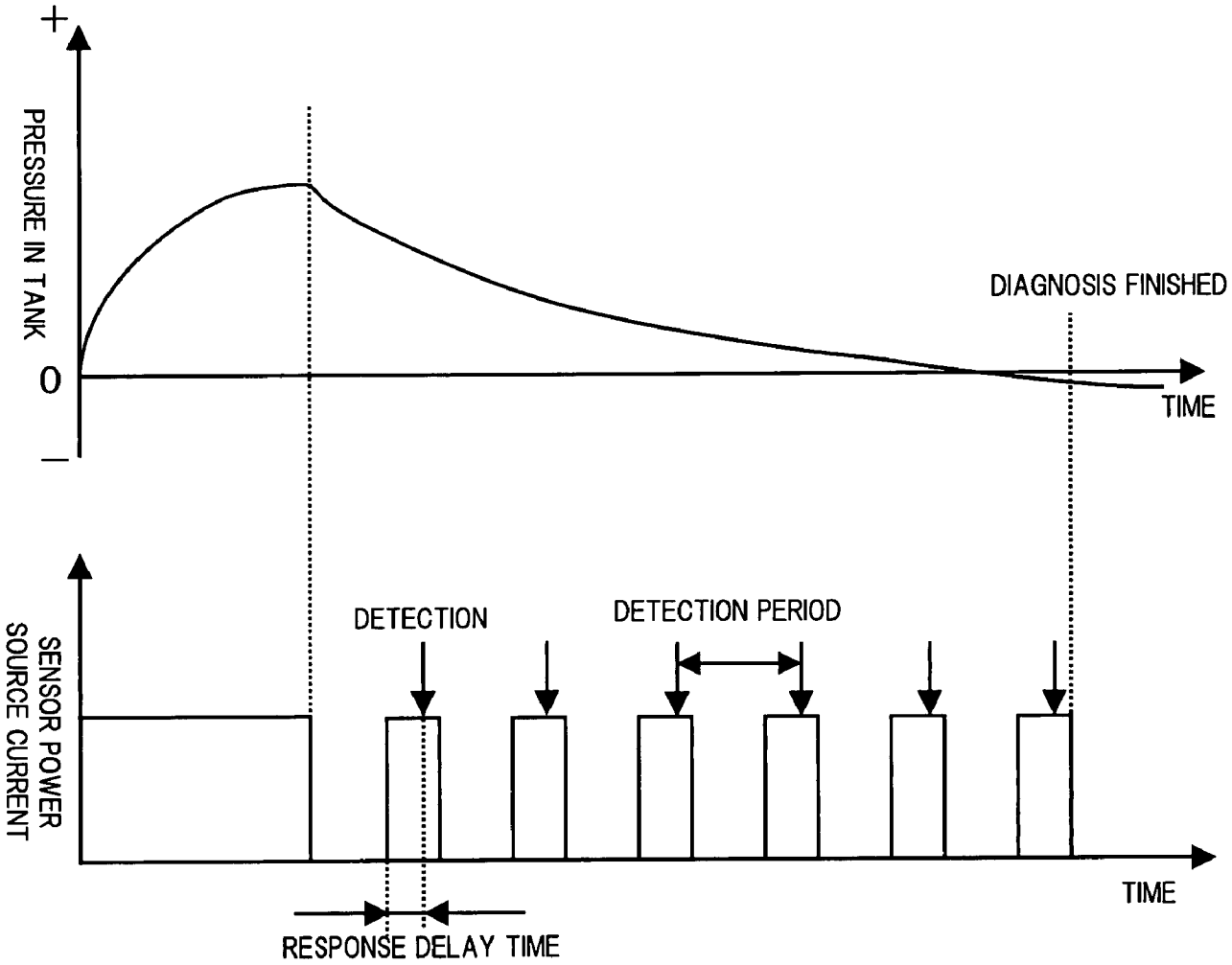
FIG. 3 is a time chart showing a characteristic of the leakage diagnosis in the embodiment.

The pressure in fuel tank 5 rises due to the evaporation of fuel just after the engine operation is stopped, and thereafter, starts to be reduced due to the condensation of the time when the temperature of the gasoline vapor is lowered (refer to FIG. 3).

If it is judged in step S4 that the pressure rise in fuel tank 5 is stopped, control proceeds to step S5.

In step S5, a previously set long period is set as the detection period of the pressure in fuel tank 5.

Then, in step S6, there is set a response delay time until pressure sensor 24 generates a desired output after a control for starting the power supply to pressure sensor 24 is performed.

The response delay time includes a delay time until the power is actually supplied to pressure sensor 24 after the control for starting the power supply is performed, and a delay time until the desired output is generated after the power is supplied to pressure sensor 24.

In the present embodiment, the power supply to pressure sensor 24 is started at a point of time before pressure detection timing by the response delay time. As a result, it is possible to detect the pressure in fuel tank 5 at the pressure detection timing and also it is possible to extend a period of time during which the power supply to pressure sensor 24 is stopped as long as possible.

Note, the response delay time may be a previously stored fixed time, or may be variably set according to the temperature of pressure sensor 24 or the power source voltage of pressure sensor 24.

If the response delay time is set in step S6, control proceeds to step S7.

In step S7, the power supply to pressure sensor 24 is stopped.

In step S8, it is judged whether or not it is the point of time before the detection timing in accordance with the detection period set in step S5, by the response delay time.

Then, if it becomes the point of time before the detection timing by the response delay time, control proceeds to step S9.

In step S9, the power necessary for the pressure detection starts to be supplied to pressure sensor 24.

In step S10, it is judged whether or not the pressure detection based on the output signal from pressure sensor 24 is finished.

Here, the power supply condition to pressure sensor 24 is kept until the pressure detection is finished, and control proceeds to step S11 when the pressure detection is finished.

In step S11, it is judged whether or not a finishing condition of leakage diagnosis is established.

To be specific, it is judged that the finishing condition is established, at a point of time when the pressure in the fuel tank is lowered to be less than a predetermined negative pressure, or a point of time when a previously set diagnosis time has elapsed.

Here, if the pressure in the fuel tank is lowered to be less than the predetermined negative pressure, it is judged that there is no leakage.

On the other hand, when the pressure in the fuel tank does not reach the predetermined negative pressure even after the lapse of the previously set diagnosis time, it is judged that the leakage occurs.

If it is judged in step S11 that the finishing condition of leakage diagnosis is not established, control returns to step S7, where the power supply to pressure sensor 24 is stopped.

Namely, the power supply to pressure sensor 24 is started at the point of time before the detection timing in accordance with the detection period set in step S5 by the response delay time, until the finishing condition of leakage diagnosis is established, and after the pressure detection is finished, the process of stopping the power supply to pressure sensor 24 is repetitively performed (refer to FIG. 3).

Accordingly, when the power supply to pressure sensor 24 is stopped after the pressure detection is finished, the power supply to pressure sensor 24 is kept in a stopped condition, during a period of time until it becomes the point of time before next detecting timing by the response delay time.

As a result, since the power to pressure sensor 24 is not wastefully supplied during a period of time between the pressure detection timings, it is possible to reduce the power consumption of pressure sensor 24 during the leakage diagnosis.

If it is judged in step S11 that the finishing condition of leakage diagnosis is established, control proceeds to step S12.

In step S12, the power supply to pressure sensor 24 is stopped.

In next step S13, control unit 20 shifts itself to the stop mode or the low power consumption mode.

Thus, it is avoided that control unit 20 consumes the large power after the leakage diagnosis is finished, so that the power consumption during the engine operation is stopped, can be effectively reduced in cooperation with a reduction effect of power consumption in pressure sensor 24.

Note, in the above embodiment, the power supply to pressure sensor 24 is completely shut off during the period of time between the pressure detection timings.

Figure 4:
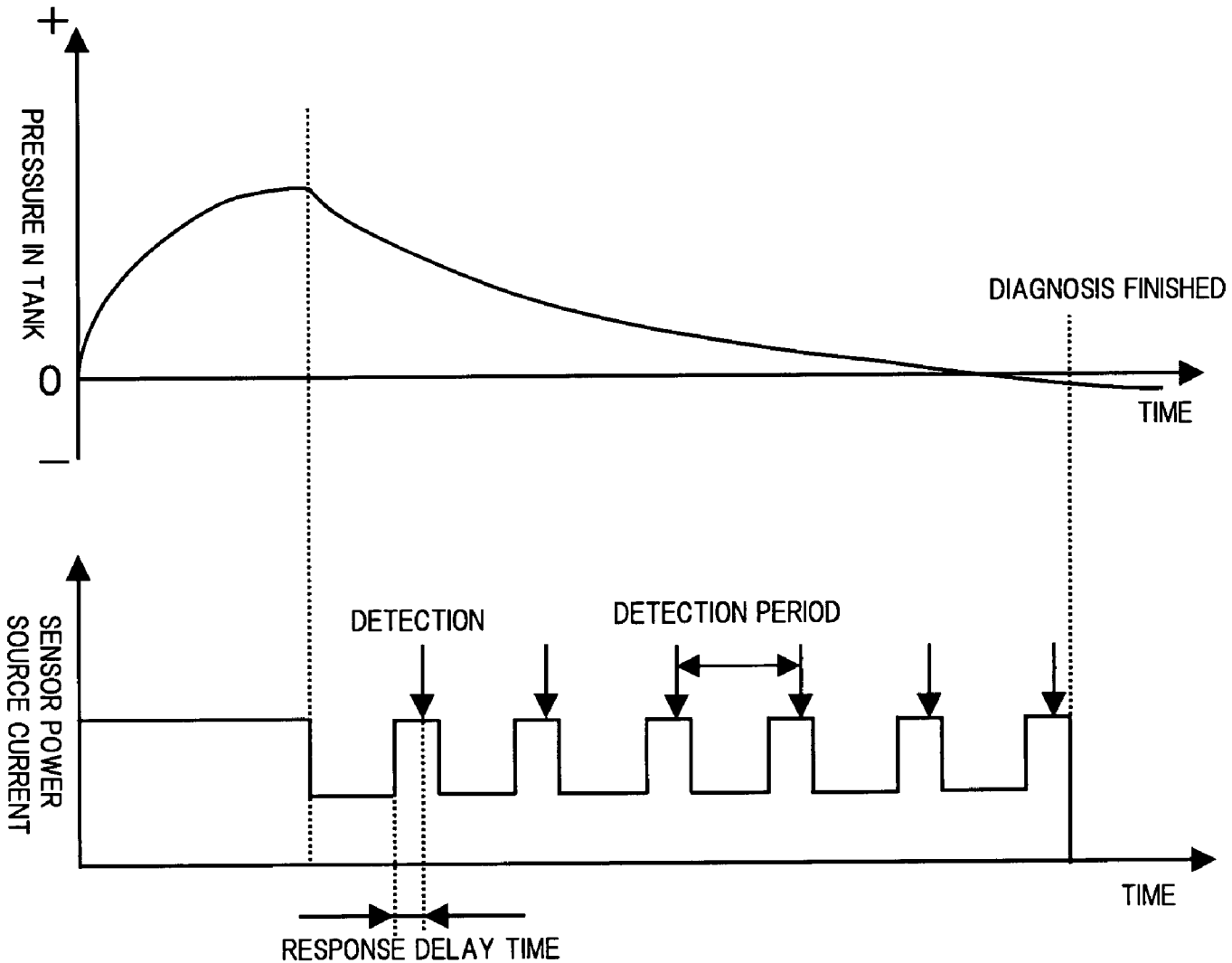
FIG. 4 is a time chart showing an embodiment in which the power to be supplied to a pressure sensor is lowered between each pressure detecting timing.

However, as shown in FIG. 4, the constitution can be such that a condition where the power supply to pressure sensor 24 is lowered, is kept, to increase the power supplied to pressure sensor 24 to a value necessary for the pressure detection, at the point of time before the detection timing by the response delay time.

Also in this case, the power consumption of pressure sensor 24 during the period of time between the pressure detection timings can be reduced.

Further, since the low power continues to be supplied to pressure sensor 24 even during the period of time between the pressure detection timings, the response delay time is shortened so that a period of time for supplying the high power to pressure sensor 24 at each detection timing, can be shortened.

In the above leakage diagnosis, it is possible that the temperature in the fuel tank together with the pressure in the fuel tank is detected, to perform the leakage diagnosis based on a correlation between the pressure and the temperature.

Further, it is possible that the pressure in the fuel tank is periodically detected to be stored within a previously set period of time after the engine operation is stopped, to perform the leakage diagnosis based on the stored pressure detection value, after the engine operation is restarted.

Moreover, a unit for leakage diagnosis can be provided independently from control unit 20.

Furthermore, the detection of vehicle state after the engine operation is stopped, is not limited to the one for leakage diagnosis, and also the sensor detecting the vehicle state is not limited to pressure sensor 24.

The entire contents of Japanese Patent Application No. 2003-195448 filed on Jul. 11, 2003, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

What is claimed is:

1. A control apparatus for a vehicle in which an engine is installed, comprising:

a detector outputting a signal corresponding to a state of said vehicle; and a control unit that receives an output signal from said detector to detect said vehicle state and also controls the power supply to said detector, wherein said control unit controls the power supply to said detector according to a detection request of said vehicle state, when receiving the output signal from said detector during an operation of said engine is stopped.

2. A control apparatus for a vehicle according to claim 1, wherein said control unit supplies intermittently to said detector the power necessary for an operation of said detector in synchronism with a period of detecting said vehicle state.

3. A control apparatus for a vehicle according to claim 2, wherein said control unit stops the power supply to said detector in an interval of the detection of said vehicle state.

4. A control apparatus for a vehicle according to claim 2, wherein said control unit lowers the power to be supplied to said detector to be less than the power necessary for the operation of said detector in an interval of the detection of said vehicle state.

5. A control apparatus for a vehicle according to claim 2, wherein said control unit starts the power supply to said detector at a point of time before timing of detecting said vehicle state by a predetermined time.

6. A control apparatus for a vehicle according to claim 5, wherein said control unit sets said predetermined time according to the power source voltage of said detector.

7. A control apparatus for a vehicle according to claim 5, wherein said control unit sets said predetermined time according to the temperature of said detector.

8. A control apparatus for a vehicle according to claim 1, wherein said control unit shuts off the supply of operation power by itself after the detection of said vehicle state during the operation of said engine is stopped, is completed.

9. A control apparatus for a vehicle according to claim 1, wherein said control unit shifts to a low power consumption mode after the detection of said vehicle state during the operation of said engine is stopped, is completed.

10. A control apparatus for a vehicle according to claim 1, wherein said engine is provided with a fuel vapor purge system, said detector is a pressure detector detecting a pressure in a processing path in said fuel vapor purge system, and said control unit blocks said processing path after the operation of said engine is stopped, to judge whether or not the leakage occurs in said processing path, based on the pressure detected by said pressure detector during the operation of said engine is stopped.

11. A control apparatus for a vehicle in which an engine is installed, comprising:

detecting means for outputting a signal corresponding to a state of said vehicle;

power supply control means for controlling the power supply to said detecting means according to a detection request of said vehicle state during an operation of said engine is stopped; and calculating means for receiving to calculate an output signal from said detecting means.

12. A control method for a vehicle equipped with an engine and also equipped with a detector outputting a signal corresponding to a state of said vehicle, comprising the steps of:

detecting a condition where an operation of said engine is stopped;

controlling the power supply to said detector according to a detection request of said vehicle state during the operation of said engine is stopped; and detecting said vehicle state based on an output signal from said detector.

13. A control method for a vehicle according to claim 12, wherein said step of controlling the power supply to said detector comprises the steps of:

setting a period of detecting said vehicle state during the operation of said engine is stopped; and supplying intermittently to said detector the power necessary for an operation of said detector in synchronism with said period.

14. A control method for a vehicle according to claim 13, wherein said step of controlling the power supply to said detector further comprises the step of;

stopping the power supply to said detector in an interval of the detection of said vehicle state.

15. A control method for a vehicle according to claim 13, wherein said step of controlling the power supply to said detector further comprises the step of;

lowering the power to be supplied to said detector to be less than the power necessary for the operation of said detector in an interval of the detection of said vehicle state.

16. A control method for a vehicle according to claim 13, wherein said step of controlling the power supply to said detector comprises the steps of:

detecting timing before detection timing of said vehicle state by a predetermined time as timing for starting the power supply; and starting the power supply to said detector at the timing for starting the power supply.

17. A control method for a vehicle according to claim 16, wherein said step of detecting the timing for starting the power supply comprises the steps of:

detecting the power source voltage of said detector; and setting said predetermined time according to said power source voltage.

18. A control method for a vehicle according to claim 16, wherein said step of detecting the timing for starting the power supply comprises the steps of:

detecting the temperature of said detector; and setting said predetermined time according to the temperature of said detector.

19. A control method for a vehicle according to claim 12, further comprising the steps of:

judging that the detection of said vehicle state during the operation of said engine is stopped, is completed; and shifting to a stop mode after the detection of said vehicle state is completed.

20. A control method for a vehicle according to claim 12, further comprising the steps of:

judging that the detection of said vehicle state during the operation of said engine is stopped, is completed; and shifting to a low power consumption mode after the detection of said vehicle state is completed.

* * * * *